United States Patent [19]

Landa

[11] Patent Number: 4,469,461

[45] Date of Patent: Sep. 4, 1984

[54] LOW PROFILE KEYBOARD ACTUATOR

[75] Inventor: Benzion Landa, Edmonton, Canada

[73] Assignee: Savin Corporation, Stamford, Conn.

[21] Appl. No.: 410,912

[22] Filed: Aug. 24, 1982

Related U.S. Application Data

[63] Continuation of Ser. No. 855,818, Nov. 30, 1977, abandoned.

[51] Int. Cl.[3] ..... B41J 5/08

[52] U.S. Cl. ..... 400/473; 400/62; 400/474; 400/478

[58] Field of Search ..... 400/62, 63, 365, 370, 400/377, 472, 473, 474, 478

[56] References Cited

U.S. PATENT DOCUMENTS

| | | | |
|---|---|---|---|
| Re. 26,954 | 9/1970 | Greene | 400/478 X |
| 1,067,566 | 7/1913 | Wikander | 400/474 |
| 1,422,433 | 7/1922 | Fries | 400/473 X |
| 1,616,025 | 2/1927 | Burns | 400/473 |
| 1,904,784 | 4/1933 | Garrity et al. | 400/474 X |
| 2,247,275 | 6/1941 | Buckley | 400/473 X |
| 2,346,819 | 4/1944 | Buckley | 400/474 X |
| 2,433,349 | 12/1947 | Drewell | 400/473 |
| 3,217,850 | 11/1965 | Frechette et al. | 400/377 X |
| 3,371,764 | 3/1968 | Aden et al. | 400/377 X |
| 3,386,554 | 6/1968 | Everhard | 400/377 X |
| 3,413,624 | 11/1968 | Murdoch et al. | 400/62 X |
| 3,452,851 | 7/1969 | Holmes, Jr. | 400/478 X |
| 3,780,846 | 12/1973 | Kolpek et al. | 400/63 |
| 3,967,715 | 7/1976 | Kohlhage et al. | 400/377 X |

FOREIGN PATENT DOCUMENTS

| | | | |
|---|---|---|---|
| 249043 | 7/1912 | Fed. Rep. of Germany | 400/474 |
| 1223595 | 6/1960 | France | 400/473 |

*Primary Examiner*—Ernest T. Wright, Jr.
*Attorney, Agent, or Firm*—Shenier & O'Connor

[57] ABSTRACT

A low profile keyboard actuator for a typewriter in which L-shaped levers are pivotally mounted on a transverse shaft mounted immediately in front of the typewriter. The levers have generally horizontal arms of various lengths, the ends of which contact the keys of the various rows of the keyboard. The levers have depending arms of uniform length and are resiliently biased to depress the keys. A common operating bar bearing against the depending arms cyclically permits the levers to depress the keys and then restores the levers to the original position where no key is depressed; however, depression of all but a selected key is inhibited by a plurality of vertically superposed, transversely shiftable, binary-coded slides having teeth which bear against all depending arms except that one corresponding to the selected key. An electric keyboard mounted above the horizontal arms provides signals which shift the slides and actuate the common operating bar to permit depression of a corresponding key of the typewriter. These signals are alternatively provided from a data source for automatic operation of the typewriter.

20 Claims, 7 Drawing Figures

Fig 1
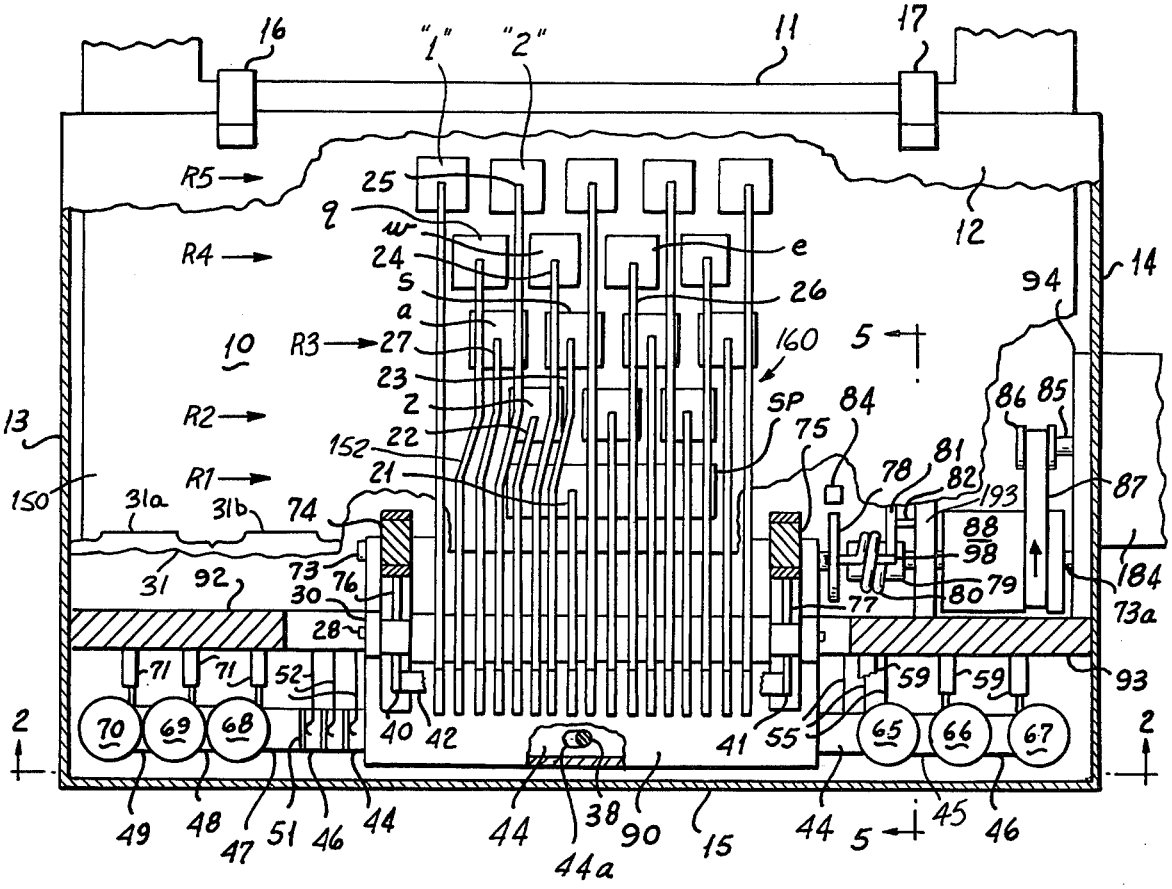
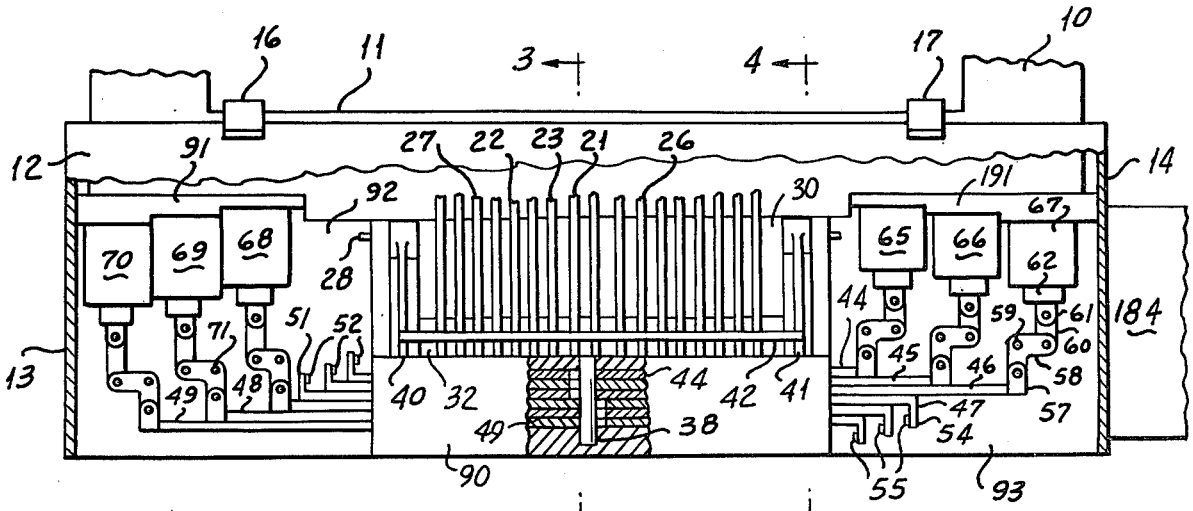
Fig 2

LOW PROFILE KEYBOARD ACTUATOR

This application is a continuation of my application, Ser. No. 855,818, filed Nov. 30, 1977, now abandoned.

BACKGROUND OF THE INVENTION

Electrically powered typewriters of the prior art have been adapted for automatic playback operation from a data source by mounting inside the typewriter various switches for sensing the depression of keys and various solenoids to produce the mechanical effect of depression of a key. The outputs of the various switches are recorded; and automatic typing is subsequently effected by using the recorded data to actuate the solenoids. Such conversion of a powered typewriter into an automatic typewriter requires laborious disassembly and reassembly of the typewriter itself, in order to install the auxiliary switches and solenoids; and if automatic operation of the typewriter is no longer desired, then the typewriter must be disassembled in order to remove the auxiliary components. Such devices for converting powered typewriters into automatic typewriters are shown in Murdoch et al U.S. Pat. No. 3,413,624 and Holmes U.S. Pat. No. 3,452,851.

Other devices of the prior art for automatic operation of a typewriter include externally mounted members for depressing the individual keys of the keyboard. Such devices are exemplified in Buckley U.S. Pat. No. 2,346,819 and Drewell U.S. Pat. No. 2,433,349. My invention contemplates an improvement over these two patents.

SUMMARY OF THE INVENTION

One object of my invention is to provide a keyboard actuator which occupies minimal volume over the keyboard and minimal volume in front of the typewriter.

Another object of my invention is to provide a low profile keyboard actuator of high speed wherein the key depressing members are mounted for low friction rotary movement about a pivot.

Still another object of my invention is to provide a low profile keyboard actuator of low inertia and consequent high speed in which the key actuating levers are pivotally mounted at a point intermediate their ends.

A further object of my invention is to provide a low profile keyboard actuator employing L-shaped levers having generally horizontal arms overlying the keyboard and generally vertically depending arms in front of the typewriter.

A still further object of my invention is to provide a low profile keyboard actuator wherein all control forces are applied to the depending arms.

A still further object of my invention is to provide a low profile keyboard actuator wherein an auxiliary electric keyboard mounted above the generally horizontal arms overlying the typewriter keyboard provides signals which actuate a corresponding lever.

Other and further objects of my invention will appear from the following description:

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a plan view with parts broken away of my low profile keyboard actuator mounted on a typewriter.

FIG. 2 is a front view with parts broken away taken along the line 2—2 of FIG. 1.

DESCRIPTION OF THE PREFERRED EMBODIMENT

Figure 3:
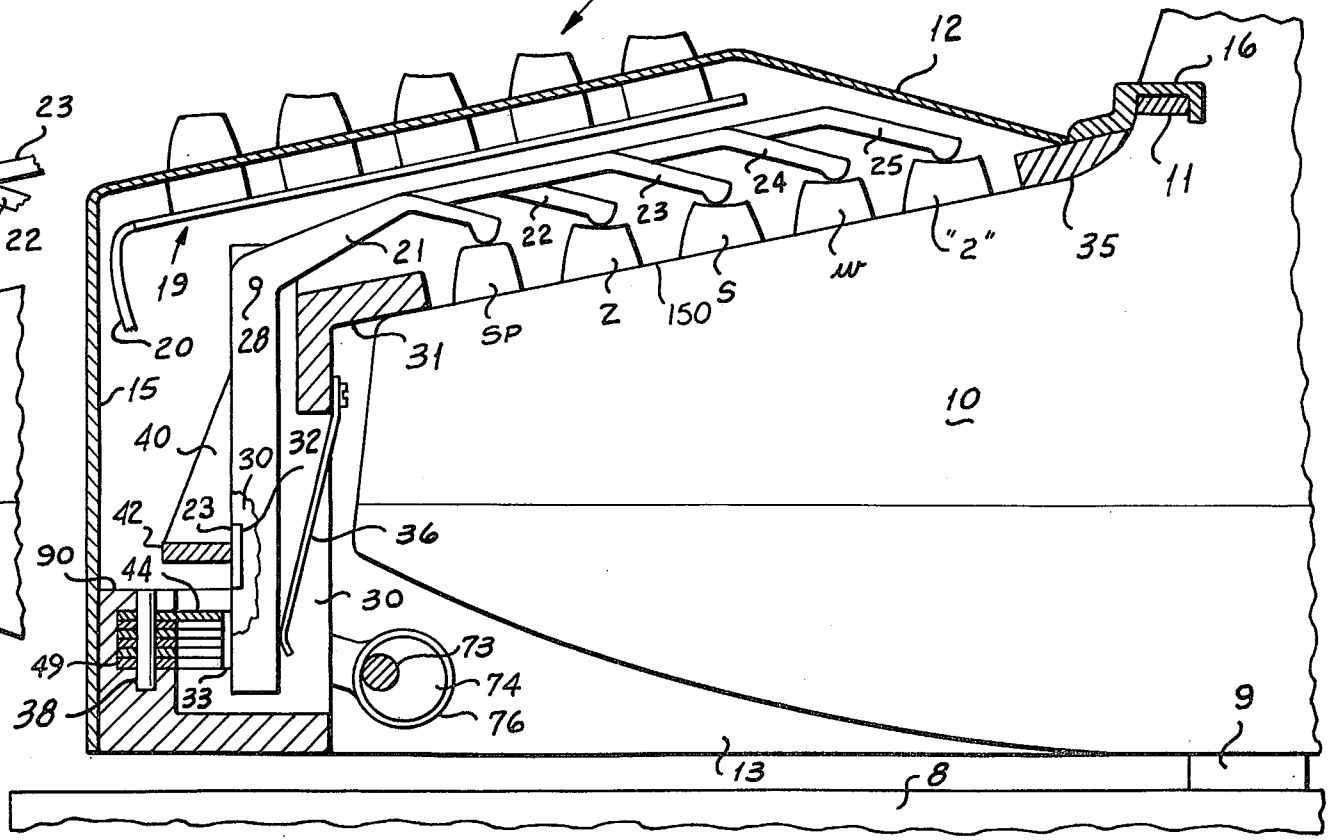
FIG. 3 is a side sectional view taken along the line 3—3 of FIG. 2.

Referring now more particularly to FIGS. 1, 2 and 3 of the drawing, my keyboard actuator includes a cover having an upper wall 12, a left side wall 13, a right side wall 14, and a front wall 15. The cover is mounted on the typewriter 10 by a pair of hooks 16 and 17, which engage a member 11 of the typewriter 10. Hooks 16 and 17 are secured to a frame member 35 which extends transversely of the typewriter 10 and bears against the upper surface 150 thereof adjacent member 11. A further frame member 31 extends transversely of the typewriter 10 and bears against the upper surface 150 thereof adjacent the operator. Portions 31*a* and 31*b* of frame member 31 bear against surface 150 of typewriter 10 at transversely spaced locations. Extending through the upper wall 12 are auxiliary keys 18, which actuate cricket switches mounted on an electric keyboard 19. The electrical signals from the switches of keyboard 19 are applied to a bundle of output conductors 20.

In FIG. 1, the typewriter keyboard is shown in a truncated from which, however, is sufficient to indicate the repetitive pattern of the keys in the five rows R1 through R5. Overlying the typewriter keyboard are the generally horizontally extending arms of an array of levers 160 including levers 21, 22, 23, 24 and 25. Lever 21 operates the spacer bar SP, which is the only key in the first row R1. Lever 22 may, for example, actuate the key for the letter "z" in the second row R2. Lever 23 may actuate the key for the letter "s" in the third row R3. Lever 24 may, for example, actuate the key for the letter "w" in the fourth row R4 and lever 25 may actuate the key for the numberal "2" in the fifth row R5. The levers 160 are pivotally mounted on a shaft 28, carried by a member 30, which extends transversely in front of the typewriter 10 somewhat above the plane of the top surface 150 of the typewriter 10 which usually slopes somewhat downwardly toward the operator as shown in FIG. 3.

In FIG. 1, it will be noted that there is a gap in the repetitive pattern of keys, in that there is no key in the second row R2 to the left of the key for the letter "z". This gap in the pattern makes possible the operation of the spacer bar SP. In few typewriters does the left-hand end of the spacer bar extend sufficiently to the left that the "q" lever 152 could actuate the spacer bar; and in some typewriters the left-hand end of the spacer bar is aligned with the left-hand end of the key for the letter "s". The "q" lever 152 and levers 27, 25, 22, 24 and 23 are each bent slightly to the right as may be seen in FIG. 1 between the first row R1 and the second row R2, thus to shift the tips of these levers 22–25, 27 and 152 relative to the key pattern. Accordingly, spacer bar lever 21 is aligned with the tip portion of lever 23 which contacts the key for the letter "s". It will be understood that if the spacer bar extends sufficiently to the left that its left-hand end is aligned with the left-hand end of the key for the letter "z", then the lever for the spacer bar could be aligned with the tip portion of lever 22 which contacts the key for the letter "z"; and levers 24 and 23 could then be straight as are the remaining levers 160 to the right of lever 21.

Figure 4:
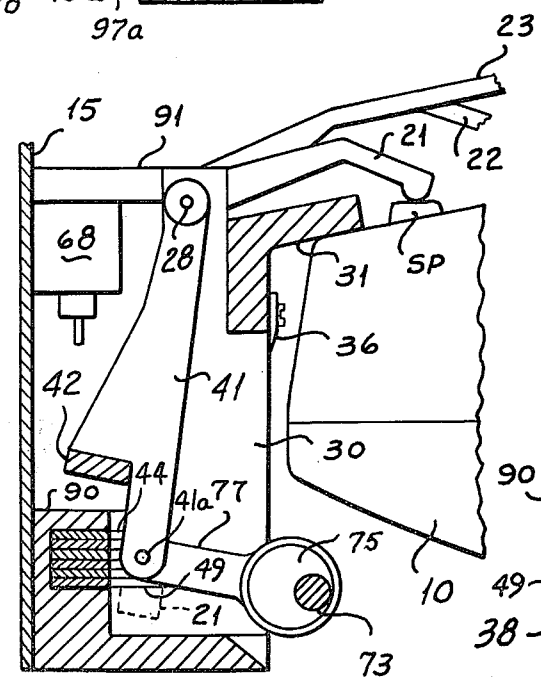
FIG. 4 is a fragmentary side sectional view taken along the line 4—4 of FIG. 2.

Each lever 160 has a depending arm which rides in vertically extending slots in member 30. Member 30 includes a base portion 90 having a transversely extending square slot 33 which houses six slides 44, 45, 46, 47, 48 and 49. The slides 44–49 are retained by a pin 38. Slide 46 is provided at its left-hand end with an upstanding projection 51; and slides 44 and 45 are provided with similar upstanding projections. Slide 47 is provided at its right-hand end with a depending projection 54; and slides 48 and 49 are provided with similar depending projections. Slide 44 is provided with a slot **44*a* of somewhat greater transverse extent than the diameter of the retaining pin 38; and the other slides 45–49 are provided with similar slots. Leaf springs 52 engage the upstanding projections 51 of slides 44, 45 and 46 and urge the slides 44–46 to the left until the right-hand edge of the slot engages pin 38. Leaf springs 55 engage the depending projections 54 of slides 47, 48 and 49 and urge the slides 47–49 to the right until the left-hand edge of the slot engages pin 38. Slide 46 is provided at its right-hand end with upstanding ears 57 which pivotally receive the lower end of the vertically extending arm of an L-shaped link 58. Link 58 is pivotally mounted on a stationary shaft 59. The right-hand end of the horizontal arm of link 58 is pivotally connected to the lower end of a vertically extending link 60, the upper end of which is pivotally mounted in a tab 61 on the plunger 62 of a solenoid 67. Upon actuation of solenoid 67, the plunger 62 moves upwardly, thus rotating link 58 counterclockwise and moving slide 46 to the right against the biasing force of spring 52, until the left-hand edge of its slot engages pin 38. Upper slides 44 and 45 are similarly shifted by solenoids 65 and 66 through L-shaped links mounted on shafts 59. Similarly, slides 47, 48 and 49 are actuated by solenoids 68, 69 and 70 through L-shaped links which are pivotally mounted on stationary shafts 71. For example, actuation of solenoid 69 causes clockwise rotation of its link about shaft 71, thus moving slide 48 to the left until the right-hand edge of its slot engages pin 38. Upon deactivation of solenoid 67, slide 46 moves to the left under the biasing force of spring 52 back to the position shown. Similarly, upon deactivation of solenoid 60, slide 48 moves to the right under the biasing force of spring 55 to the position shown. Member 30 is provided with transverse extensions 92 and 93, upon which the link shafts 71 and 59 are mounted. Extension 92 is provided with an overhang 91 (FIGS. 2 and 4) beneath which solenoids 68, 69 and 70 are mounted. Extension 93 is provided with a similar overhang 191 beneath which solenoids 65, 66 and 67** are mounted.

The depending arm of each lever 160 is biased toward key depressing position by a leaf spring 36 mounted on transverse frame member 31. As may be seen by reference to FIG. 3, the tip of leaf spring 36 bears against the right-hand edge of the depending arm of lever 21.

A common operating bar 42 bears against the left-hand edge of the depending arm of each lever 160 in FIG. 3. Operating bar 42 is mounted on transversely spaced arms 40 and 41. Arms 40 and 41 are pivotally mounted on shaft 28. The vertically slotted member 30 is provided with a transversely extending cutout 32, so that, as shown in FIG. 3, the operating bar 42 can return the depending arms of the levers 160 to a vertical position without contacting member 30. In the "home" position shown in FIG. 3, the operating bar 42 does not bear against member 30; and the depending arms of the levers 160 do not bear against the teeth of the slides 44–49 riding in transverse slot 33. Thus, in the home position shown in FIG. 3, the slides 44–49 may be moved to various positions since their teeth are out of mesh with all of the depending arms of the levers 160. A transverse shaft 73 extends underneath the front of the typewriter 10 and mounts a pair of transversely spaced eccentrics 74 and 75. Eccentric 75 is coupled by a connecting rod 77 to a pivotal connection at the lower end of arm 41. Similarly, eccentric 74 is provided with a connecting rod 76, which is pivotally connected to the lower end of arm 40. As may be seen by reference to FIG. 4, when shaft 73 is rotated through half a revolution, the eccentrics 74 and 75 and connecting rods 76 and 77 rotate operating arms 40 and 41 clockwise, thereby moving the operating bar 42 toward the front wall 15. All of the levers 160 will rotate clockwise through a minute angle until the depending arms contact the teeth of one or more slides 44–49 in slot 33. If, however, the slides 44–49 are so actuated that no tooth of any slide 44–49 inhibits motion of a lever 160, as for example lever 21, then that lever 21 will rotate sufficiently under the biasing force of spring 36 to operate the spacer bar SP.

Figure 5:
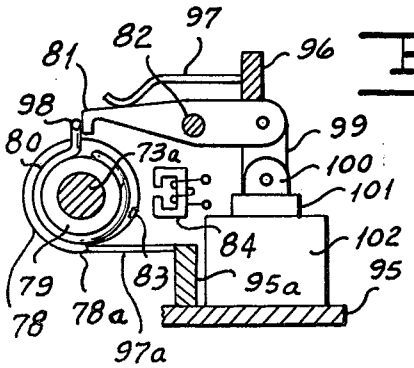
FIG. 5 is a sectional view taken along the line 5—5 of FIG. 1.

The lateral extension member 93 is provided with a rearwardly extending frame member 94, which runs along the right side wall 14. Mounted on member 94 is an alternating current motor 184. Mounted on the motor shaft 85 is a pulley 86 of relatively small diameter. A shaft **73*a* is mounted in member 94 with its axis aligned with that of shaft 73. Mounted on shaft 73*a* is a flywheel 88 of relatively large diameter compared with that of pulley 86. A belt 87 extends from pulley 86 to a circumferentially extending pulley cutout in flywheel 88. Also mounted on shaft 73*a* is the drum 79 of a one-revolution clutch. Mounted at the right-hand end of shaft 73 is a flange 78 which receives one end of a helical spring 80 wound around drum 79. The other end of spring 80 is provided with an upstanding projection 98, as may be seen by reference to FIGS. 1 and 5. The inside diameter of the helical spring 80 is normally less than the outside diameter of drum 79. Thus, in mounting the helical spring 80 upon the drum 79, the spring 80 will be slightly expanded and tend to grip the drum 79. In FIG. 5, shaft 73*a* rotates clockwise as may be seen from the direction arrow on belt 87 in FIG. 1. Thus, rotation of drum 79 produces a self-servo action which causes spring 80 to grip drum 79 more tightly in proportion to the loading torque on shaft 73**.

The spring clutch is disabled or released by a horizontally disposed lever 81, the forward end of which engages the upstanding projection 98 of spring 80. Lever 81 is pivotally mounted intermediate its ends on a shaft 82 which is secured to a rearwardly extending projection 193 from lateral extension member 93. As may be seen by reference to FIG. 5, the rear or right-hand end of lever 81 is pivotally connected to the upper end of a link 99, the lower end of which is pivotally connected to a tab 100 secured to the plunger 101 of a clutch solenoid 102. Solenoid 102 is secured to a horizontal plate 95 which extends from the lateral extension member 93.

Lever 81 is biased by a leaf spring member 97 for counterclockwise rotation until the right-hand or rear end of lever 81 bears against a limit stop member 96. Spring 97 is mounted on member 96; and member 96 is mounted on the same rearward projection 193 which mounts shaft 82.

Upon actuation of solenoid 102, plunger 101 moves downwardly, thus rotating lever 81 clockwise against the biasing forces of spring 97. The forward or left-hand end of lever 81 releases the upstanding projection 98 of the helical spring 80. Spring 80 thus grips the drum 79; and shaft 73 now rotates synchronously with shaft 73*a*. If solenoid 102 is deactivated, lever 81 rotates counterclockwise under the influence of leaf spring 97 back to the position shown. After drum 79 has completed one revolution, the upstanding projection 98 will engage the forward end of lever 81, thus uncoiling spring 80 slightly, so that it no longer grips drum 79. Thus, the clutch is disengaged after one revolution. The opposing torque on flange 78 and shaft 73 in uncoiling spring 80 causes shaft 73 to come to rest.

Imbedded in the periphery of flange 78 is a small element 83 formed of a permanent magnet material. A magnetic detector 84 comprising a coil wound on a high permeability core having a small air gap is mounted adjacent the path traversed by the magnet 83. As shown in FIG. 5, in order to provide some anticipation the element 83 is so mounted relative to the detector 84 that in the home position shown element 83 has rotated some 15° beyond the air gap of detector 84.

Flange 78 is provided with an inwardly spiraling cam surface which begins at the point where magnet 83 is imbedded and terminates at a sharp tooth-like transition 78*a*. A leaf spring 97*a* engages the cam surface of flange 78. Spring 97*a* is supported by a member 95*a* mounted on member 95. When projection 98 engages lever 81, the uncoiling of spring 80 brings shaft 73 to a stop after some overtravel of perhaps 5° to 15° beyond the "home" position shown. Spring 80 then recoils itself, driving shaft 73 and flange 78 counterclockwise until spring 97*a* engages the tooth-like abrupt transition 78*a*. This prevents spring 80 from recoiling itself sufficiently to drip drum 79.

As shown in FIG. 3, the typewriter is provided with a foot 9 which rests upon the surface of a table or desk 8.

Figure 7:
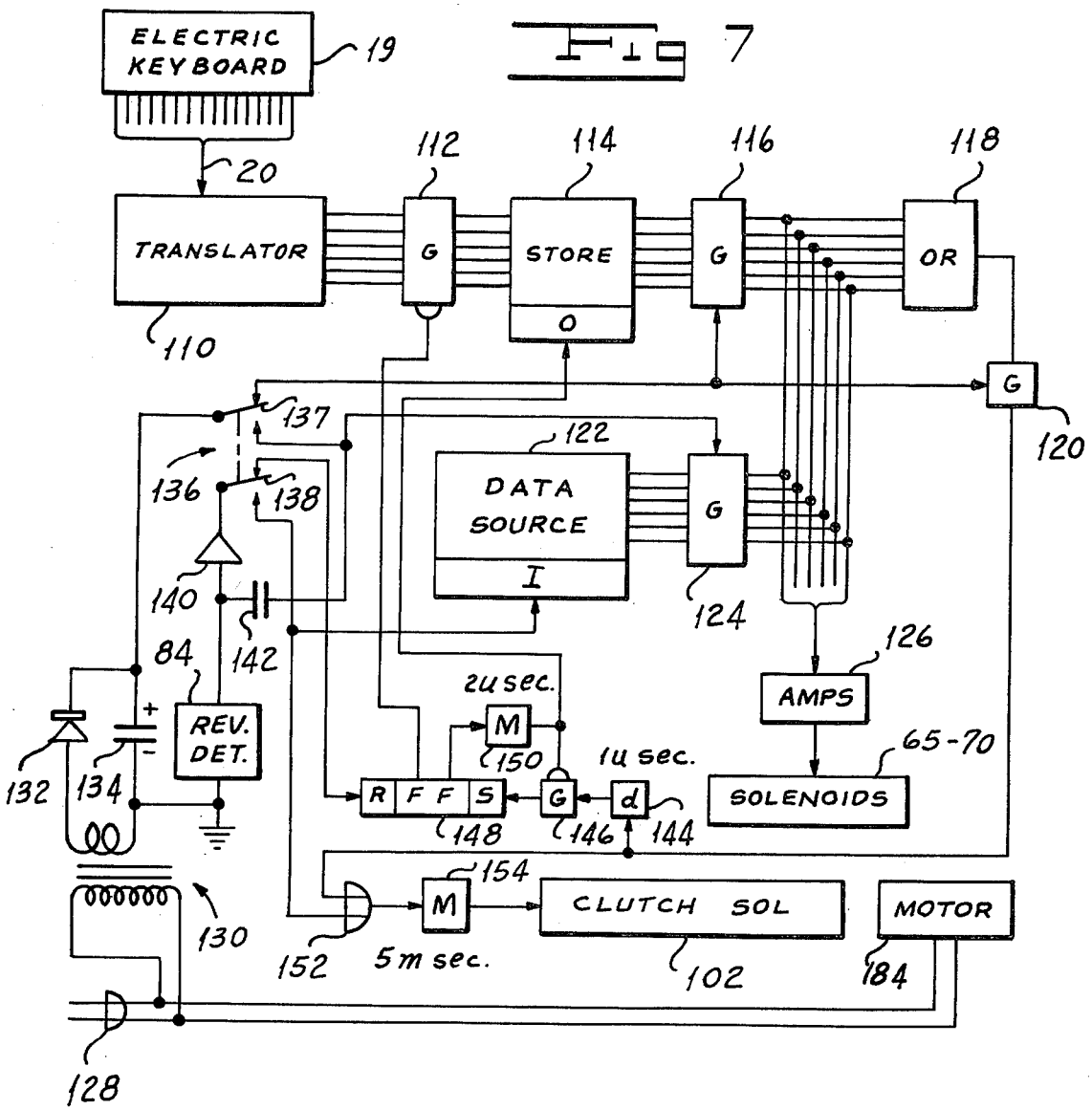
FIG. 7 is a schematic view of the electrical circuitry of my invention.

Referring now to FIG. 7, the outputs from the cricket switches of the electric keyboard 19 are coupled through a bundle of conductors 20 to a translator 110, which converts an input from the electric keyboard 19 into six binary coded outputs corresponding to the six slide solenoids 65 through 70. The outputs of translator 110 are coupled through a gate 112 to a storage circuit or register 114. The outputs from storage register 114 are coupled through a gate 116 to six amplifiers 126 which operate corresponding solenoids 65 through 70. The outputs of gate 116 are also coupled to an OR circuit 118.

A wall plug 128 provides a convenient source of electrical power which is coupled to motor 184 and to the primary winding of a step-down transformer 130. One terminal of the secondary winding of transformer 130 is grounded; and the other terminal thereof is coupled forwardly through a rectifier 132 to the positive plate of a filter capacitor 134, the negative plate of which is grounded. The positive plate of capacitor 134 is coupled to the armature of one switch 137 of a manually operable double-pole double-throw switch indicated generally by the reference numeral 136. The winding of revolution detector 84 is applied between ground and the input of an amplifier 140. The output of amplifier 140 is coupled to the armature of the second switch 138 of the double-pole switch 136. The upper contact of switch 137 is connected to an enabling input of gate 116 and to an enabling input of a gate 120. The output of OR circuit 118 is coupled through gate 120 to a circuit 144 which provides a time delay of one microsecond. The output of delay network 144 is coupled through a gate 146 to the setting input of a flip-flop 148. One output of flip-flop 148 is coupled to an inhibiting input of gate 112. The other output of flip-flop 148 is applied to a mono-stable multivibrator 150 which provides an output pulse of two microseconds duration. The output of multivibrator 150 is applied to an inhibiting input of gate 146 and to a resetting input of register 114 which restores the output thereof to zero. The upper contact of switch 138 is applied to a resetting input of flip-flop 148. The output of gate 120 is applied to an OR circuit 152, the output of which is applied to a mono-stable multivibrator 154 which provides an output pulse of 5 milliseconds duration. The output of multivibrator 154 drives clutch solenoid 102.

With the armatures of switch 136 in the positions shown engaging the upper contacts, electrical signals from keyboard 19 obtained by depressing an auxiliary key 18 actuate the solenoids 65 through 70 and the clutch solenoid 102 to cause a corresponding key of the typewriter 10 to be depressed. When flip-flop 148 is reset, gate 112 normally couples the outputs from translator 110 to the storage register 114. With the armature of switch 137 in the position shown, gates 116 and 120 are enabled. When storage register 114 provides an output on one or more of its six lines, these outputs are coupled through gate 116 to amplifiers 126 which in turn actuate corresponding solenoids 65 through 70. Any signals applied through gate 116 to amplifiers 126 are also applied to the OR circuit 118 which concurrently produces an output. The output from OR circuit 118 is coupled through gate 120 and OR circuit 152 to multivibrator 154, which pulses the clutch solenoid 102. The signal from gate 120, after a slight delay provided by network 144 is coupled through gate 146 to set flip-flop 148. The first output of flip-flop 148 now disables gate 112 so that the electric keyboard 19 is rendered ineffective to change the signals stored in register 114.

The pulsing of clutch solenoid 102 causes shaft 73 to complete a full revolution during which the operating bar 42 moves forwardly and then backwardly to the home position and a corresponding one of the L-shaped levers 160 depresses and releases a key of the typewriter 10. At a point 15° before completion of a full revolution of shaft 73, detector 84 provides an output pulse which is applied through amplifier 140 and the upper contact of switch 138 to reset flip-flop 148. The second output of flip-flop 148 triggers multivibrator 150, which resets the output of the storage register 114 to zero and disables gate 146 for a period sufficiently longer than the delay provided by network 144 to ensure that the trailing edge of the decaying pulse from OR circuit 118 does not inadvertently cause setting of flip-flop 148. With resetting of flip-flop 148, the first output thereof no longer inhibits gate 112. Accordingly, a new signal from the electric keyboard 19 produced by actuation of a key 18 will be coupled from translator 110 through gate 112 to storage register 114 and thereby cause depression of a new key of typewriter 10 which corresponds to key 18.

Referring still to FIG. 7, an auxiliary data source 122 may, for example, comprise magnetic tape upon which has been previously recorded the outputs of storage register 114. When automatic operation is desired, switch 136 is actuated to its alternate position where the armatures of switches 137 and 138 engage the lower contacts. The six outputs from data source 122 are coupled through a gate 124 to the inputs of amplifiers 126. The lower contact of switch 137 is applied to an enabling input of gate 124 and is coupled through a differentiating capacitor 142 to the input of amplifier 140. The lower contact of switch 138 is coupled to an indexing input of the data source 122. The data source 122 may, for example, include a buffer register for storing the six binary coded bits of a plurality of letters corresponding, for example, to an entire line of typing. The lower contact of switch 138 is further connected to a second input of OR circuit 152.

When automatic typing is desired, switch 136 is actuated, moving the armatures of swtiches 137 and 138 to the alternate position. Upon the actuation of switch 136 to its alternate position, a pulse is coupled through differentiating capacitor 142 to the input of amplifier 140. This pulse simulates that which would be produced by revolution detector 84. However, since the magnetic element 83 is initially not in a position to provide this pulse, the synthetic pulse provided by capacitor 142 initiates the subsequent sequence of events. The output of amplifier 140 is coupled through OR circuit 152 to trigger multivibrator 154 which actuates clutch solenoid 102. Simultaneously, the output from amplifier 140 indexes the data source 122 to provide binary coded signals in accordance with the first letter or character to be typed. Since gate 124 is now enabled by the potential at the lower contact of switch 137, these signals are coupled through gate 124 to the amplifiers 126 and thence to the solenoids 65 through 70.

Certain typewriters such as the IBM "Selectric" have the capability of typing 900 characters per minute which corresponds to 15 characters per second. Since it is desired that my keyboard actuator require no auxiliary sensors or devices mounted internally of the typewriter 10, it is necessary in automatic typing that the data source 122 provide character signals at a rate not exceeding, for example, 800 characters per minute, or 13.33 characters per second. Accordingly, the ratio of the diameter of the small pulley 86 to that of the flywheel 88 should be such that the flywheel 88 rotates at a rate of 800 revolutions per minute or 13.33 revolutions per second. The time required for one revolution of the flywheel 88 will accordingly be 75 milliseconds. It is assumed that the clutch solenoid 102 will actuate lever 81 to lift its forward or left-hand end clear of the path of projection 98 within two milliseconds after triggering of multivibrator 154. The two millisecond time delay of solenoid 102 is accompanied by a shaft rotation of (2/75) 360=9.6°. Since the magnetic element 83 passes the air gap of sensor 84 some 15° before the "home" position, ample time is afforded for solenoid 102 to cause the left-hand end of lever 81 to be raised out of the path of projection 98 before the projection 98 strikes the end of the lever 81.

Accordingly, 15°, or three milliseconds, before shaft 73 has completed a full revolution, detector 84 provides an output pulse which is coupled through amplifier 140 and the lower contact of switch 138 to index the data source 122 and to trigger multivibrator 154. This provides the six binary coded bits of the second character to be typed and raises the left-hand end of the lever 81 so that projection 98 passes thereunder without disabling the spring clutch. Accordingly, shaft 73 rotates continously at a rate of 13.33 revolutions per second, thus depressing the keys of typewriter 10 at this rate. Two milliseconds (or 10°) after projection 98 passes under the left-hand end of lever 81, solenoid 102 is deactivated, thus permitting lever 81 to return to the position shown. Since the duty cycle of the clutch solenoid 102 is very low, it can be pulsed with high currents for fast speed of response without excessive average power dissipation.

Figure 6:
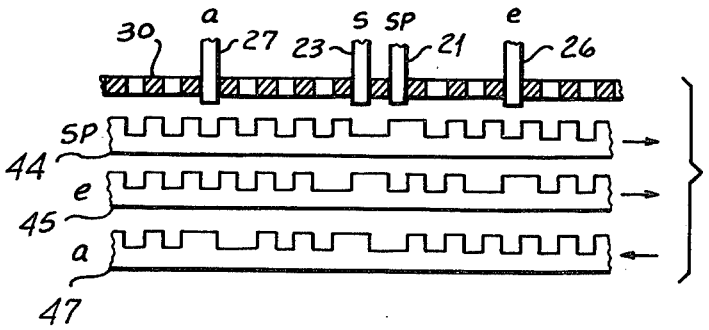
FIG. 6 is an exploded view showing the relationship of the binary coded slides.

Referring now to FIG. 6, there is shown an exploded view of the arrangement of teeth on three of the six slides 44–49 for the levers 27, 23, 26 and 21, which cause depressing of the typewriter keys "a", "s", "e" and the spacer bar key SP. In agreement with FIG. 2, slides 44 and 45 are normally positioned to the left by the return springs 52 and may be actuated to the right by solenoids 65 and 66. Similarly, slide 47 is normally positioned to the right by spring 55 and may be moved to the left by solenoid 68. In the normal position of the slides 44–49 the depending arm of lever 21, which operates the spacer bar SP, is opposed by a tooth of slide 44. All other slides 45–49, including slides 45 and 47 have a groove in alignment with the depending arm of lever 21. Accordingly, the inhibiting of lever 21 is accomplished only by slide 44. The depending arm of lever 26 for the "e" key, is opposed by a tooth of slide 45. All other slides 44 and 46–49 including 44 and 47 have a groove in alignment the depending arm of lever 26. Accordingly, actuation of lever 26 is inhibited only by slide 45. The depending arm of lever 27, for the "a" key, is opposed by a tooth of slide 47. All other slides 44–46, 48 and 49, including slides 44 and 45 have a groove at this point. Accordingly, actuation of lever 27 is inhibited only by slide 47. To cause lever 21 to depress the spacer bar SP, slide 44 is actuated to the right, so that a groove is now in alignment with the depending arm of lever 21. To cause lever 26 to depress the "e" key, slide 45 is moved to the right, so that a groove is now aligned with the depending arm of lever 26. To cause lever 27 to depress the "a" key, slide 47 is moved to the left, so that a groove is now aligned with the depending arm of lever 27.

The most frequent letter in the English language is "e", having a frequency of approximately 12% to 13%, excluding spaces between words, The average length of an English word is approximately 4.5 letters. When the space between words is included, approximately 5.5 characters are required for an average word. This means that the spacer bar SP will have a frequency of approximately 18% and that the letter "e" will have a frequency of 10% to 11%. The six most frequent characters and letters will thus be "space", "e", "t", "a", "o", and either "n" or "i". In order to reduce the power consumption of solenoids 65 through 70, it is desired that only one of the six slides 44–49 be actuated for each one of the six most frequent characters. Thus, only slide 46 need be actuated for the letter "t"; only slide 48 need be actuated for the letter "o"; and only slide 49 need be actuated for the letter "n". All other letters and characters will require the actuation of two or more slides 44–49.

For example, the letter "s" is of fairly high frequency; and from FIG. 6 it will be noted that the depending arm of lever 23 is inhibited by a tooth of slide 45 and a tooth of slide 47. For all other slides 44, 46, 48 and 49 including slide 44, the depending arm of lever 23 is opposed only by a groove. Simultaneous actuation of slide 45 to the right and of slide 47 to the left will thus remove all inhibiting teeth from alignment with the depending arm of lever 23; and actuation of the common operating bar 42 will permit lever 23 to depress the "s" key.

Translator 110 of FIG. 7 comprises six OR circuits, each OR circuit corresponding to one of the six solenoids 65 through 70. Translator 110 and the teeth of slides 44 through 49 may be constructed in accordance with the following character coding table:

| Character | Code | Character | Code |
|---|---|---|---|
| SP | 100000 | . | 001011 |
| e | 010000 | , | 010110 |
| t | 001000 | ; | 101100 |
| a | 000100 | 0 | 011001 |
| o | 000010 | 1 | 110010 |
| n | 000001 | 2 | 100101 |
| i | 000101 | 3 | 001101 |
| r | 001010 | 4 | 011010 |
| h | 010001 | 5 | 110100 |
| s | 010100 | 6 | 101001 |
| l | 100010 | 7 | 010011 |
| d | 101000 | 8 | 100110 |
| c | 000011 | 9 | 010101 |
| u | 000110 | ' | 101010 |
| p | 001100 | - | 111100 |
| f | 011000 | = | 111001 |
| m | 100001 | ] | 110011 |
| w | 110000 | / | 100111 |
| y | 001001 | | 001111 |
| b | 010010 | | 011110 |
| g | 100100 | | 111010 |
| v | 000111 | | 110101 |
| k | 001110 | | 101011 |
| q | 011100 | | 010111 |
| x | 111000 | | 101110 |
| j | 110001 | | 011101 |
| z | 100011 | | 110110 |
| | | | 101101 |
| | | | 011011 |

From the table it will be noted that the six highest frequency character signals from the electric keyboard 19 are coupled to the input of only a single OR circuit of translator 110, so that only a single slide solenoid 65–70 need be actuated. The fifteen intermediate frequency letters i, r, h, s . . . w, y, b, g are accompanied by signals from the electric keyboard 19 which are coupled to only two of the OR circuits of translator 110 and hence actuate only two of the slide solenoids 65–70. The six low frequency letters v, k, q, x, j, z are accompanied by signals from the electric keyboard 19 which are coupled to only three of the OR circuits of translator 110 and hence actuate only three of the slide solenoids 65–70. Examining the table it will be seen that the first OR circuit of translator 110 which actuates solenoid 65 receives an input from electric keyboard 19 upon depression of the following character keys: SP, l, d, m, w, g, x, j, and z. The second OR circuit of translator 110 which operates solenoid 66 receives an input upon depression of the following letter keys of the electric keyboard 19: e, h, s, f, w, b, q, x, and j. The fourth OR circuit of translator 110, which actuates solenoid 68, receives an input upon depression of the following letter keys of the electric keyboard 19: a, i, s, u, p, g, v, k, and q. Correspondingly, the "x" output from electric keyboard 19 is applied to the first and second and third OR circuits of translator 110; and the "v" output of keyboard 19 is applied to the fourth and fifth and sixth OR circuits of translator 110. It will be appreciated that translator 110 is so arranged that the composite frequencies of actuation of the six solenoids 65–70 are substantially equal.

It will be understood of course that the typewriter 10 is provided with further character keys for the numerals 0 and 1 through 9 and for various marks of punctuation, which form a part of the repetitive pattern of keys shown in rows two through five (R2–R5) of FIG. 1. The typewriter 10 also includes such function keys as carriage return, shift, tabulator and back space. These functions especially the carriage return, the tabulator and the back space require appreciably more time than does the typing of a character. Furthermore, the operation of the shift, while very rapid, is invariably accompanied by the actuation of one of the character keys. Accordingly, the carriage return, tabulator, back space and shift functions are best performed by independent operators. From the table it will be seen that only the four most infrequent characters require the simultaneous actuation of as many as four of the six solenoids 65–70. For example, actuation of the slash key of the electric keyboard 19 applies signals to the first, fourth, fifth and sixth OR circuits of translator 110 to energize the corresponding four solenoids 65–70 and their associated slides 44–49.

It will be seen that I have accomplished the objects of my invention. My keyboard actuator has a low profile and occupies minimal space above the keyboard of the typewriter and minimal space in front of the typewriter itself. The pivotal mounting of the L-shaped levers results in minimal friction. The pivotal mounting of the key actuating levers also results in minimal inertia, since only the ends of the levers move through large distances, while those portions of the levers adjacent the pivot shaft have minimal motion. As is well known to the art angular inertia depends upon an $mr^2$ law, wherein the effective inertia of a mass, m, is proportional to the square of its distance, r, from the pivot. The mounting of the levers for rotation about a pivot intermediate its ends greatly reduces the angular inertia for the same reason. Accordingly, my keyboard actuator has a high speed of response without employing excessively heavy spring loads on the levers. This reduces friction and wear; and the reduced load on the mechanism for actuating the common operating bar reduces the power consumption of the drive motor. Thus, my keyboard actuator has low maintenance and long life. Operation of typewriter keys is effected only by the actuating levers; and an auxiliary keyboard 19 provides only electrical signals for this purpose with no direct mechanical connection to the keys of the typewriter itself. The levers are electrically operated either by the auxiliary keyboard for manual typing or by an auxiliary data source for automatic typing.

It will be understood that certain features and subcombinations are of utility and may be employed without reference to other features and subcombinations. This is contemplated by and is within the scope of my claims. It will be further understood that various changes may be made in details within the scope of my claims without departing from the spirit of my invention. It is, therefore, to be understood that my invention is not to be limited to the specific details shown and described.

Having thus described my invention, what I claim is:

1. An actuator for a keyboard including in combination a shaft, means mounting the shaft in front of the keyboard and extending transversely thereof, a plurality of levers, means pivotally mounting each lever on the shaft at a point intermediate its ends, each lever having a generally horizontally extending first arm which overlies the keyboard and a second arm, means effectively biasing each lever in a direction tending to pivot its first arm downwardly with a force sufficient to actuate a key of the keyboard, and controllable means including means bearing against the second arms of the levers for selectively governing pivotal movement thereof.

2. An actuator as in claim 1 wherein the biasing means includes a plurality of leaf springs bearing against the second arms of the levers.

3. An actuator as in claim 1 wherein the controllable means includes a plurality of transversely movable slides having teeth bearing against the second arms of the levers.

4. An actuator as in claim 1 wherein the controllable means includes a transversely extending common operating bar bearing against the second arm of each lever.

5. An actuator as in claim 1 wherein the controllable means includes a transversely extending operating bar, a pair of members, means pivotally mounting the members at transversely spaced locations on the shaft, means mounting the operating bar on the members, and means for synchronously driving the members.

6. An actuator as in claim 1 wherein the controllable means includes a pair of transversely spaced eccentrics and means for synchronously driving the eccentrics.

7. An actuator as in claim 1 wherein the controllable means includes a one revolution clutch.

8. An actuator as in claim 1 for a typewriter having keys for the characters "q" and "a" and "2" and "z" and "w" and "s" and having a spacer bar key, wherein each first arm comprises a base portion adjacent the shaft and a tip portion remote from the shaft which contacts a corresponding key, the base portion of each arm being disposed in a corresponding vertical plane, the tip portion of the spacer bar arm being disposed in the plane of its base portion, and the tip portion of the "q" arm being disposed in the plane of the base portion of an adjacent arm.

9. An actuator as in claim 8 wherein the tip portion of one of the "q" and "a" and "2" and "z" and "w" and "s" arms is disposed in the plane of the spacer bar arm.

10. An actuator as in claim 8 wherein the tip portion of the "q" arm is disposed in the plane of the base portion of the "a" arm.

11. An actuator as in claim 8 wherein the tip portion of the "a" arm is disposed in the plane of the base portion of the "2" arm.

12. An actuator as in claim 8 wherein the tip portion of the "2" arm is disposed in the plane of the base portion of the "z" arm.

13. An actuator as in claim 8 wherein the tip portion of one of the "z" and "w" and "s" arms is disposed in the plane of the spacer bar arm.

14. An actuator as in claim 1 for a typewriter capable of typing a certain number of characters per second, wherein the controllable means includes a drive shaft and means for rotating the drive shaft at a rate such that the number of revolutions per second is somewhat less than said certain number.

15. An actuator as in claim 1 wherein the controllable means includes a motor, a drive shaft, means including a one revolution clutch for coupling the motor to the drive shaft, and means including means mounted on the drive shaft for providing an electrical signal somewhat prior to the time the drive shaft completes a full revolution.

16. An actuator as in claim 1 further including an electric keyboard, means mounting the electric keyboard above the first arms of the levers, means responsive to actuation of a key of the electric keyboard for providing an electrical signal, and means responsive to said signal for actuating the controllable means, said electric keyboard having no mechanical connection with the levers or the controllable means.

17. An actuator as in claim 1 for a typewriter having a spacer bar key and a key for the high frequency letter "e" and keys for four other high frequency characters, wherein the controllable means includes six binary coded toothed slides each transversely shiftable from a first position corresponding to a binary "0" to a second position corresponding to a binary "1", means for restoring each slide to its "0" position, means for selectively shifting each slide to its "1" position, the teeth of the slides being so arranged that shifting of only a first slide to its "1" position permits actuation of the spacer bar key and that shifting of only a second slide to its "1" position permits actuation of the "e" key and that shifting of only one of the third and fourth and fifth and sixth slides to its "1" position permits actuation of the key for a corresponding one of said four other high frequency characters.

18. An actuator as in claim 1 for a typewriter wherein the controllable means includes a transversely extending drive shaft mounted beneath a front portion of the typewriter.

19. An actuator as in claim 1 for a typewriter having a first key row including a spacer bar key and a second row of keys for numerals further including means for mounting the actuator on the typewriter, the mounting means comprising a pair of transversely spaced and rearwardly extending hook elements engaging a portion of the typewriter behind said second row of keys and a pair of transversely spaced elements bearing against a generally planar top surface of the typewriter adjacent the first key row.

20. An actuator as in claim 1 wherein the levers are of generally L-shape and the second arms depend from the shaft in a generally vertical direction.

* * * * *